US010418787B2

(12) United States Patent
Hwang et al.

(10) Patent No.: US 10,418,787 B2
(45) Date of Patent: Sep. 17, 2019

(54) GROUND ELECTRODE PAD FOR SPARK PLUG

(71) Applicants: DENSO International America, Inc., Southfield, MI (US); DENSO CORPORATION, Kariya-shi, Aichi-ken (JP)

(72) Inventors: Jeongung Hwang, Northville, MI (US); Christopher Thomas, Berkley, MI (US); Harrison Boll, Grosse Pointe Farms, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/592,936

(22) Filed: May 11, 2017

(65) Prior Publication Data

US 2018/0331508 A1 Nov. 15, 2018

(51) Int. Cl.

| | |
|---|---|
| ***H01T 13/32*** | (2006.01) |
| ***H01T 21/02*** | (2006.01) |
| ***H01T 13/20*** | (2006.01) |

(52) U.S. Cl.

CPC ..... *H01T 13/32* (2013.01); *H01T 13/20* (2013.01); *H01T 21/02* (2013.01)

(58) Field of Classification Search

CPC ..... H01T 13/32; H01T 21/00; H01T 21/02; H01T 13/20; H01T 13/39

See application file for complete search history.

(56) References Cited

U.S. PATENT DOCUMENTS

| | | | | |
|---|---|---|---|---|
| 4,514,657 | A * | 4/1985 | Igashira | H01T 13/32 313/130 |
| 7,045,939 | B2 | 5/2006 | Teramura et al. | |
| 7,557,495 | B2 | 7/2009 | Tinwell | |
| 7,808,165 | B2 * | 10/2010 | Kowalski | H01T 13/32 123/169 R |
| 8,810,116 | B2 * | 8/2014 | Kasuya | H01T 13/32 313/141 |
| 9,083,154 | B2 * | 7/2015 | Niessner | H01T 13/39 |

(Continued)

FOREIGN PATENT DOCUMENTS

| | | | | |
|---|---|---|---|---|
| JP | 03001475 | A * | 1/1991 | H01T 13/39 |
| JP | H05198348 | A | 8/1993 | |
| JP | 2004079507 | A | 3/2004 | |

*Primary Examiner* — Mariceli Santiago

(74) *Attorney, Agent, or Firm* — Harness, Dickey & Pierce, P.L.C.

(57) ABSTRACT

A spark plug ground electrode assembly including a ground electrode having a ground electrode base defining a receptacle. A base flange extends about less than an entirety of the receptacle to define an open lateral end of the receptacle. The open lateral end of the receptacle is arranged to receive a ground electrode pad slid into the receptacle and onto a support surface in a direction perpendicular to a spark plug longitudinal axis. The flange of the ground electrode pad is arranged between the base flange and the support surface to restrict movement of the ground electrode pad along the spark plug longitudinal axis. A welding is at the open end of the receptacle to restrict movement of the ground electrode pad in the direction perpendicular to the spark plug longitudinal axis.

9 Claims, 4 Drawing Sheets

(56) References Cited

U.S. PATENT DOCUMENTS

| | | | | |
|---|---|---|---|---|
| 9,083,155 | B2 | 7/2015 | Yoshizaki et al. | |
| 9,236,715 | B2 * | 1/2016 | Sakakura | H01T 13/32 |
| 2004/0129683 | A1 * | 7/2004 | Torii | H01T 13/39 219/117.1 |
| 2008/0074025 | A1 * | 3/2008 | Hori | H01T 13/39 313/141 |
| 2014/0062284 | A1 | 3/2014 | Yoshizaki et al. | |

* cited by examiner

GROUND ELECTRODE PAD FOR SPARK PLUG

FIELD

The present disclosure relates to spark plugs, and particularly to ground electrode pads for spark plugs.

BACKGROUND

This section provides background information related to the present disclosure, which is not necessarily prior art.

Spark plugs typically include a ground electrode assembly having a precious metal ground electrode pad secured to a ground electrode base, such as with an electrical resistance weld. While current ground electrode assemblies are suitable for their intended use, they are subject to improvement. For example, in high temperature environments the pad may become detached from the base, such as due to the pad curling and failure of the electrical resistance weld. The present teachings advantageously provide for ground electrode assemblies in which the electrode pad is more securely coupled to the ground electrode base. The ground electrode assemblies according to the present teachings prolong spark plug life and reduce the possibility of engine damage caused by a separated ground electrode pad. One skilled in the art will appreciate that the present teachings provide numerous additional advantages and unexpected results.

SUMMARY

This section provides a general summary of the disclosure, and is not a comprehensive disclosure of its full scope or all of its features.

The present teachings provide for a spark plug ground electrode assembly including a ground electrode having a ground electrode base defining a receptacle. A base flange extends about less than an entirety of the receptacle to define an open lateral end of the receptacle. The open lateral end of the receptacle is arranged to receive a ground electrode pad slid into the receptacle and onto a support surface in a direction perpendicular to a spark plug longitudinal axis. The flange of the ground electrode pad is arranged between the base flange and the support surface to restrict movement of the ground electrode pad along the spark plug longitudinal axis. A welding is at the open end of the receptacle to restrict movement of the ground electrode pad in the direction perpendicular to the spark plug longitudinal axis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
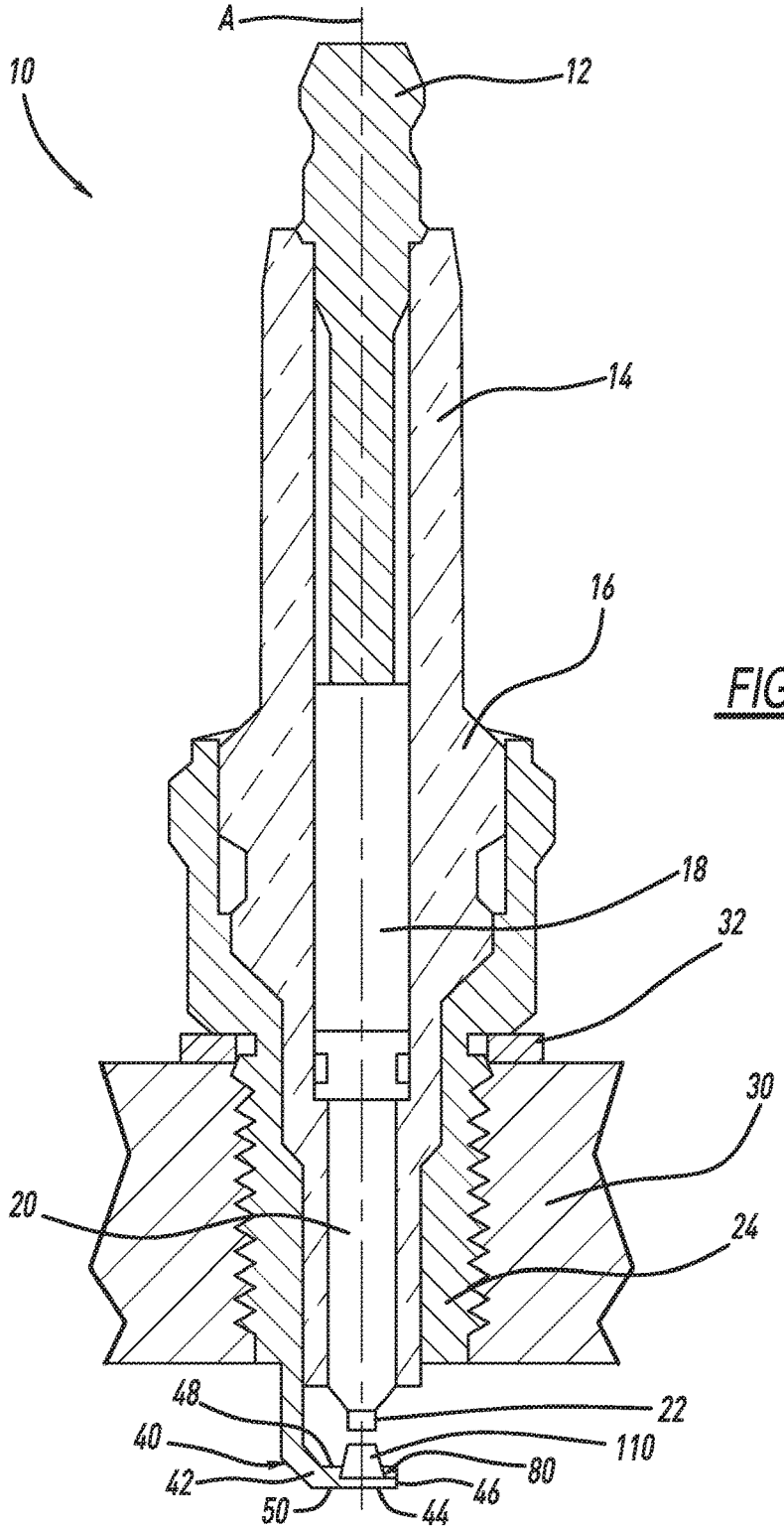
FIG. 1 is a cross-sectional view of a spark plug with a ground electrode assembly in accordance with the present teachings.

FIG. 1 illustrates a spark plug 10 in accordance with the present teachings. The spark plug 10 generally includes a terminal 12 surrounded by an insulator 14, which includes an inside housing portion 16. The terminal 12 extends along a longitudinal axis A of the spark plug 10 to a glass seal 18. Also extending along the longitudinal axis A is a center electrode 20, which has a center electrode tip 22. The longitudinal axis A extends generally through a center of the tip 22. Surrounding the center electrode 20 is a housing 24. The housing 24 is configured to be mounted to an engine head 30 in any suitable manner. The engine head 30 can be an engine head of any suitable engine. Extending around the housing 24 is a gasket 32.

Figure 2:
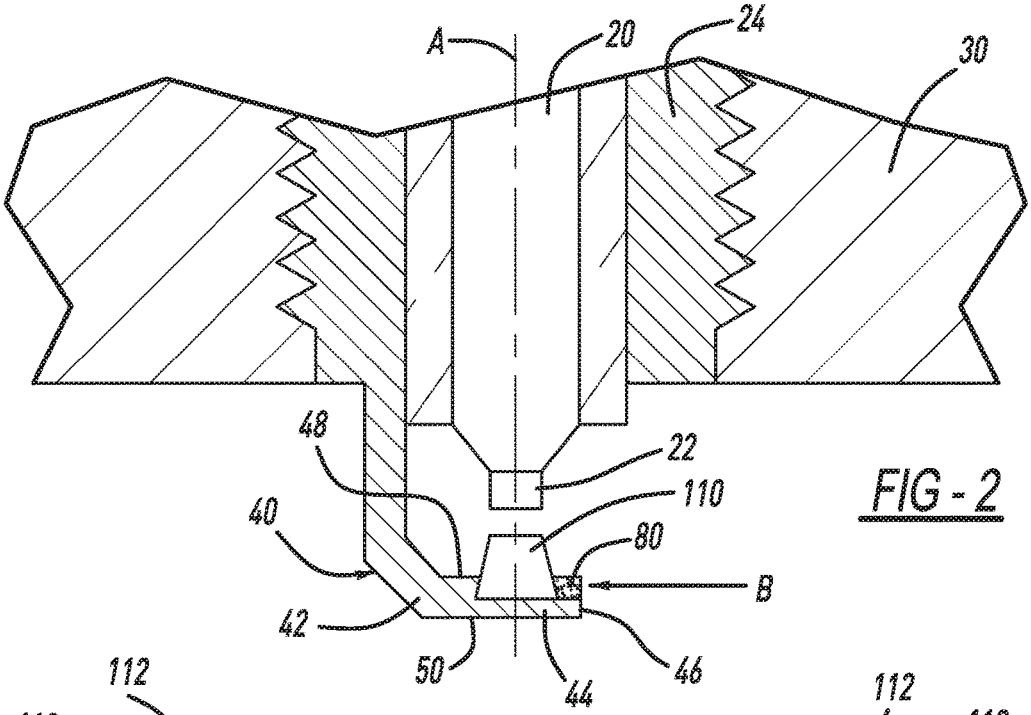
FIG. 2 is a close-up of the ground electrode assembly of FIG. 1.

With continued reference to FIG. 1 and additional reference to FIG. 2, the spark plug 10 further includes a spark plug ground electrode assembly, which has a ground electrode 40. The ground electrode 40 includes an arm having a main body section 42 and a ground electrode base 44. The ground electrode base 44 is at or adjacent to an end surface 46 of the ground electrode 40. The ground electrode base 44 includes an inner surface 48 and an outer surface 50. The inner surface 48 faces the center electrode 20, and the outer surface 50 is opposite to the inner surface 48.

Figure 3A:
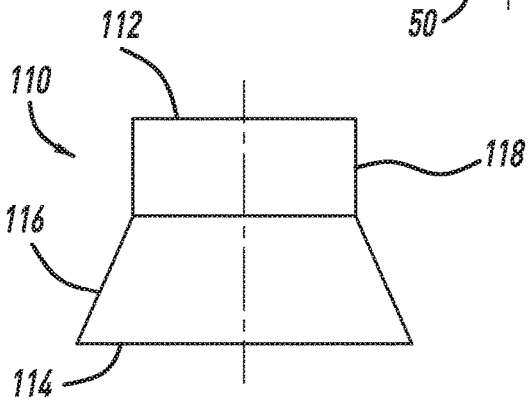
FIG. 3A is a side view of a ground electrode pad in accordance with the present teachings.
Figure 3B:
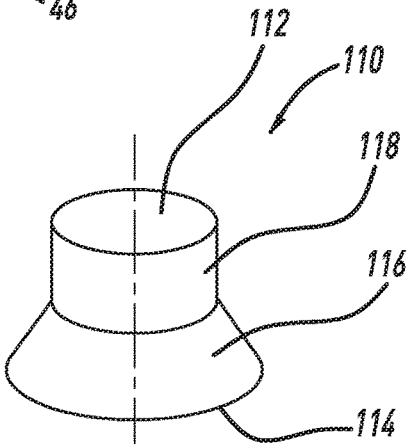
FIG. 3B is a perspective view of the ground electrode pad of FIG. 3A.

Secured to the ground electrode base 44 is a ground electrode pad 110. The ground electrode pad 110 is secured in part by a weld 80, as described further herein. With additional reference to FIGS. 3A and 3B, features of the ground electrode pad 110 will now be described. The ground electrode pad 110 includes a pad head surface 112 and a pad base surface 114, which is opposite to the pad head surface 112. The ground electrode pad 110 further includes a pad flange 116, which in the example illustrated extends from the pad base surface 114 to a linear sidewall portion 118, which extends to the pad head surface 112. The ground electrode pad 110 is generally circular. Thus the pad flange 116 is generally a circular sidewall that extends at an angle towards a longitudinal axis of the pad 110 (which is aligned with the longitudinal axis A of FIGS. 1 and 2) from the pad base surface 114. The linear portion 118 is also circular, but extends linearly and parallel to the longitudinal axis of the ground electrode pad 110. The ground electrode pad 110 (as well as the other pads 210 and 310 described herein) can be made of any suitable material, such as any suitable precious metal, such as platinum. The ground electrode 40 can be made of any suitable material, such as a nickel alloy.

Figure 4A:
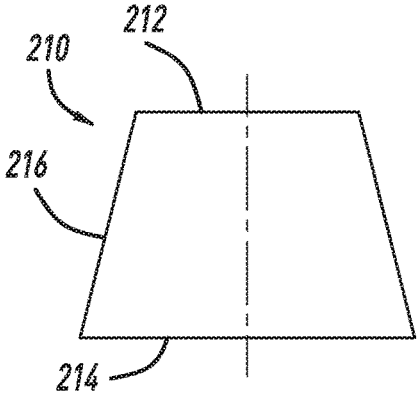
FIG. 4A is a side view of another ground electrode pad according to the present teachings.
Figure 4B:
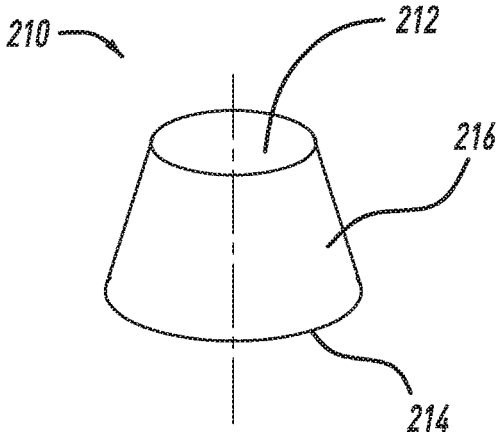
FIG. 4B is a perspective view of the ground electrode pad of FIG. 4A.

With reference to FIGS. 4A and 4B, another example of a ground electrode pad is illustrated at reference numeral 210. The ground electrode pad 210 includes a pad head surface 212, and a pad base surface 214, which is opposite to the pad head surface 212. A pad flange 216 extends completely between the pad head surface 212 and the pad base surface 214. The pad flange 216 is an angled sidewall extending entirely around a longitudinal axis of the pad 210, which is generally round.

Figure 5A:
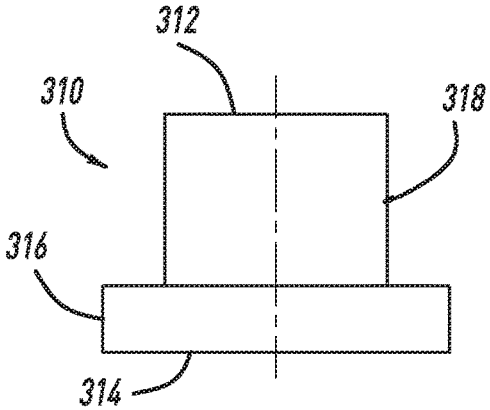
FIG. 5A is a side view of an additional ground electrode pad according to the present teachings.
Figure 5B:
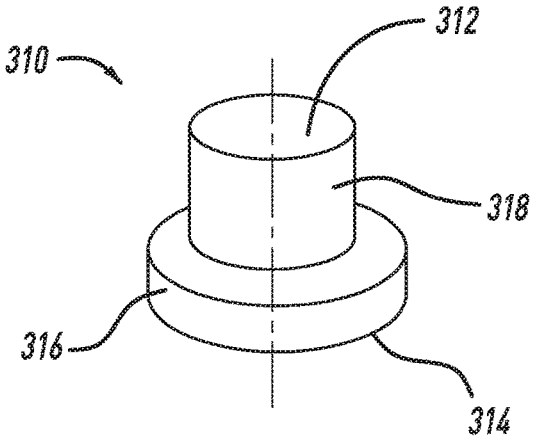
FIG. 5B is a perspective view of the ground electrode pad of FIG. 5A.

FIGS. 5A and 5B illustrate another exemplary ground electrode pad according to the present teachings at reference numeral 310. The ground electrode pad 310 includes a pad head surface 312 and a pad base surface 314 opposite thereto. At the pad base surface 314 is a pad flange 316. Between the pad flange 316 and the pad head surface 312 is a linear sidewall portion 318. Both the linear sidewall portion 318 and the pad flange 316 are generally circular and extend around a longitudinal axis of the pad 310. The pad flange 316 has a larger diameter than the linear sidewall portion 318.

Figure 6A:
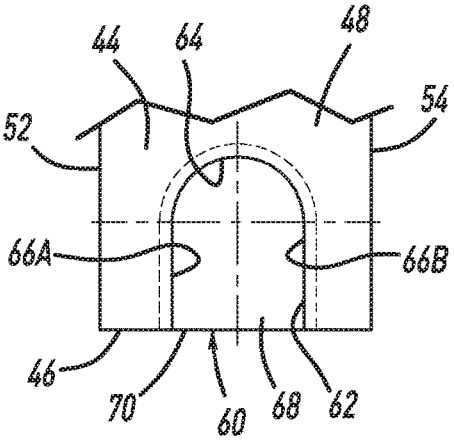
FIG. 6A is a top view of a ground electrode base in accordance with the present teachings.
Figure 6B:
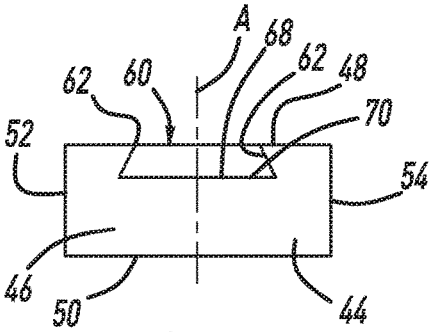
FIG. 6B is a front view of the ground electrode base of FIG. 6A.
Figure 6C:
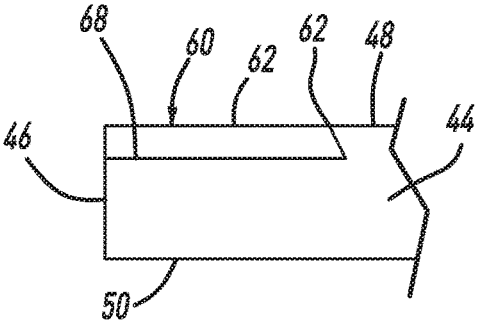
FIG. 6C is a side cross-sectional view of the ground electrode base of FIG. 6A.

With additional reference to FIGS. 6A, 6B, and 6C, additional features of the ground electrode base 44 will now be described in conjunction with an exemplary method according to the present teachings. The ground electrode base 44 includes a pad receptacle 60, which can be formed within the base 44 in any suitable manner, such as by machining. The pad receptacle 60 is formed to have a base flange 62, which is generally U-shaped. The base flange 62 includes a curved portion 64, and opposing linear portions 66A and 66B. The base flange 62 extends above a support surface 68 of the base 44, which supports the ground electrode pad 110 thereon. As the base flange 62 is generally U-shaped, it does not extend entirely about the pad receptacle 60, and at least in part defines an open end 70 of the pad receptacle 60.

Figure 7A:
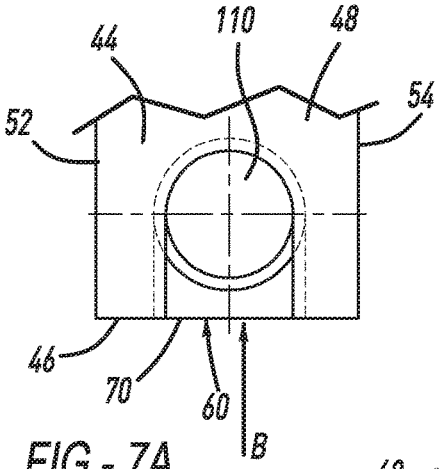
FIG. 7A is a top view of the ground electrode base of FIG. 6A with the ground electrode pad of FIGS. 3A and 3B seated therein.
Figure 7B:
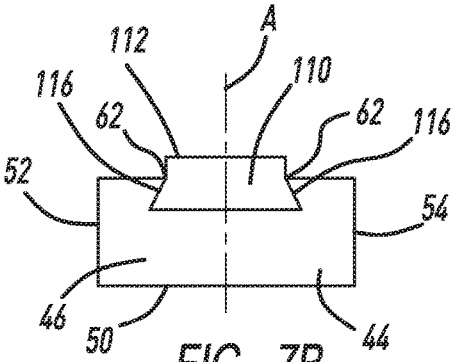
FIG. 7B is a front view of the ground electrode base of FIG. 6A with the ground electrode pad of FIGS. 3A and 3B seated therein.
Figure 7C:
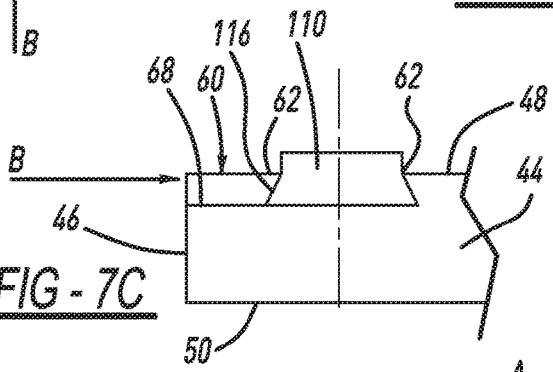
FIG. 7C is a side cross-sectional view of the ground electrode base of FIG. 6A with the ground electrode pad of FIGS. 3A and 3B seated therein.
Figure 8A:
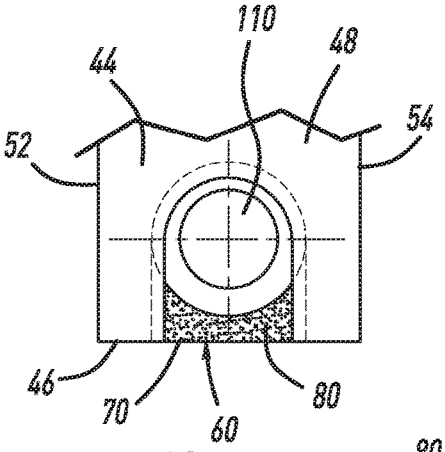
FIG. 8A is a top view of the ground electrode base of FIG. 6A with the ground electrode pad of FIGS. 3A and 3B seated therein and secured with a weld.
Figure 8B:
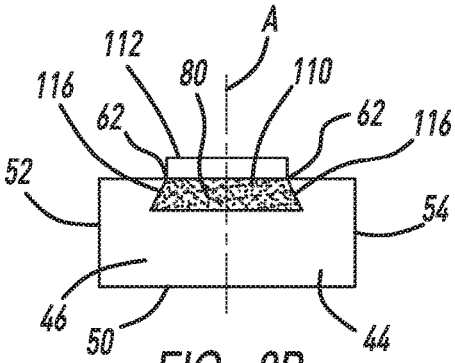
FIG. 8B is a front view of the ground electrode base of FIG. 6A with the ground electrode pad of FIGS. 3A and 3B seated therein and secured with a weld.
Figure 8C:
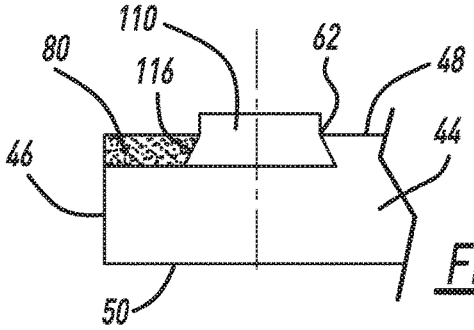
FIG. 8C is a side cross-sectional view of the ground electrode base of FIG. 6A with the ground electrode pad of FIGS. 3A and 3B seated therein and secured with a weld.

With reference to FIGS. 7A, 7B, and 7C, the ground electrode pad 110 is connected to the ground electrode base 44 by sliding the ground electrode pad 110 through the open end 70 and into the pad receptacle 60. The pad flange 116 is arranged beneath the base flange 62, which prevents the ground electrode pad 110 from moving along the longitudinal axis A towards the center electrode tip 22 (see FIGS. 1 and 2, for example). To prevent the ground electrode pad 110 from moving out from within the pad receptacle 60 back through the open end 70 in a direction perpendicular to the longitudinal axis A, the open end 70 is welded closed with any suitable weld 80, as illustrated in FIGS. 8A, 8B, and 8C. The weld 80 can be an arc weld or a laser weld, for example. The weld 80 is applied directly to the ground electrode pad 110 and the pad receptacle 60 without an intermediate part therebetween. The pad base surface 114 will be seated on the support surface 68, and the pad head surface 112 will extend above the base flange 62 and the inner surface 48 of the base 44. Thus the linear portion 118 will be arranged above the base flange 62.

The ground electrode base 44 is made of the same material throughout. For example, the material of the ground electrode base 44 at the base flange 62 is the same as the material at and beneath the support surface 68. Therefore, the portions of the ground electrode base 44 at the base flange 62, at the support surface 68, and beneath the support surface 68 all have the same coefficient of thermal expansion. As a result, even at high temperatures (such as 1,000° C.) the ground electrode pad, and specifically the pad flange 116 thereof, will remain retained and secured beneath the base flange 62 because the base flange 62 and other parts of the base 44 will not expand in a non-uniform manner.

Although FIGS. 6A-8C describe a method for securing the ground electrode pad 110 to the ground base 44, this method can be applied to any other ground electrode pad of any suitable size and shape, such as the ground electrode pads 210 (FIGS. 4A and 4B) and 310 (FIGS. 5A and 5B). For example and with respect to the pad 210, the pad 210 can be slid through the open end 70 into the pad receptacle 60 in direction B such that a portion of the pad flange 216 at and proximate to the pad base surface 114 is arranged beneath the base flange 62. The pad base surface 214 will be seated on the support surface 68, and the pad head surface 212 will extend above the base flange 62 and the inner surface 48 of the base 44. Thus a portion of the pad flange 216 at and proximate to the pad head surface 212 will be arranged above the base flange 62.

With respect to the ground electrode pad 310, it is slid through the open ends 70 into the pad receptacle 60 such that the pad base surface 314 is seated on the support surface 68, and pad flange 316 is arranged beneath base flange 62. The pad head surface 312 extends above the base flange 62 and above the inner surface 48. The base flange 62 will be sized and shaped to accommodate and clamp down onto the pad flange 316. Thus the base flange 62 will not have an angled sidewall as illustrated in FIGS. 6A-8C, but will instead have a generally linear sidewall with an overhanging surface that will accommodate and clamp down onto the pad flange 316.

The present teachings thus provide improved structures and methods for securing ground electrode pads, such as pads 110, 210, and 310, to the ground electrode base 44. Even when the ground electrode 40 and the ground electrode pads 110, 210, and 310 experience increased temperatures, such as 1,000° C., the ground electrode pads 110, 210, and 310 will remain secured to the ground electrode base 44. For example, the base flange 62 prevents the ground electrode pad 110 from separating from the base 44 and moving along the longitudinal axis A towards the center electrode tip 22. Because the ground electrode base 44 is made of the same material both at and proximate to the base flange 62, even if the base 44 experiences thermal expansion, the base flange 62 and portions of the base 44 proximate thereto will expand uniformly, thus preventing the ground electrode pad 110 from separating from the base 44. Because the weld 80 is arranged at the side of the base 44 spaced apart from the longitudinal axis A, even if the weld 80 fails, the pad 110 will be prevented from moving along the longitudinal axis A by the base flange 62, and typically remain connected to the base 44.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A spark plug comprising:

a center electrode;

a ground electrode opposite to the center electrode, the ground electrode including:

a ground electrode base;

a ground electrode pad connected to the ground electrode base, the ground electrode pad is opposite to the center electrode, the center electrode and the ground electrode pad are aligned along a longitudinal axis of the spark plug;

the ground electrode pad includes a circular pad base, a pad flange extending from the circular pad base inward towards and non-orthogonal to a longitudinal axis of the ground electrode pad, and a circular linear portion extending from the pad flange in a direction parallel to the longitudinal axis to a circular pad head surface;

a receptacle defined by the ground electrode base, the ground electrode pad is seated within the receptacle;

an opening of the receptacle offset from the longitudinal axis and arranged to receive the ground electrode pad slid into the receptacle in a direction perpendicular to the longitudinal axis;

a weld at the opening that restricts the ground electrode pad from being slid out from within the receptacle along the longitudinal axis, the weld contacts both the ground electrode base and the circular pad base, and is confined to the opening such that the weld extends along less than an entirety of the circular pad base; and a flange of the receptacle beneath which the pad flange and the pad base of the ground electrode pad are arranged to restrict movement of the ground electrode pad along the longitudinal axis towards the center electrode, the linear portion of the ground electrode pad extends beyond the flange towards the center electrode to position the pad head surface opposite to the center electrode;

wherein the flange and a remainder of the ground electrode base defining the receptacle all have an identical coefficient of thermal expansion.

2. The spark plug of claim 1, wherein the ground electrode base is at an end of a ground electrode arm.

3. The spark plug of claim 1, wherein the ground electrode pad is a precious metal.

4. The spark plug of claim 1, wherein the weld is a laser weld or an arc weld.

5. The spark plug of claim 1, wherein the ground electrode pad is circular.

6. The spark plug of claim 1, wherein the flange is U-shaped.

7. A spark plug ground electrode assembly comprising:

a ground electrode having a ground electrode base defining a receptacle;

a base flange extending about less than an entirety of the receptacle to define an open lateral end of the receptacle, the open lateral end of the receptacle is arranged to receive a ground electrode pad slid into the receptacle and onto a support surface in a direction perpendicular to a spark plug longitudinal axis;

the ground electrode pad includes a circular pad base, a pad flange extending from the circular pad base inward towards and non-orthogonal to a longitudinal axis of the ground electrode pad, and a circular linear portion extending from the pad flange in a direction parallel to the longitudinal axis to a circular pad head surface;

the pad flange and the pad base of the ground electrode pad are arranged beneath the base flange to restrict movement of the ground electrode pad along the spark plug longitudinal axis, the linear portion of the ground electrode pad extends beyond the base flange; and a welding at the open end of the receptacle to restrict movement of the ground electrode pad in the direction perpendicular to the spark plug longitudinal axis, the welding contacts both the ground electrode base and the circular pad base, and is confined to the open end such that the welding extends along less than an entirety of the circular pad base;

wherein the flange and a remainder of the ground electrode base defining the receptacle all have an identical coefficient of thermal expansion.

8. The spark plug ground electrode assembly of claim 7, wherein the base flange is U-shaped.

9. A method for securing a ground electrode pad to a ground electrode base of a spark plug, the method comprising:

machining a receptacle in the ground electrode base to define a base flange extending about less than an entirety of the receptacle, and to define an open lateral end of the receptacle;

sliding the ground electrode pad into the receptacle through the open lateral end in a direction perpendicular to a spark plug longitudinal axis, including sliding the ground electrode pad beneath the base flange to restrict movement of the ground electrode pad along the spark plug longitudinal axis; and welding shut the open end of the receptacle with a weld to restrict movement of the ground pad in the direction perpendicular to the spark plug longitudinal axis, the weld contacts both the ground electrode base and a circular pad base of the ground electrode pad, and is confined to the open end such that the weld extends along less than an entirety of the circular pad base;

wherein the ground electrode pad includes the circular pad base, a pad flange extending from the circular pad base inward towards and non-orthogonal to a longitudinal axis of the ground electrode pad, and a circular linear portion extending from the pad flange in a direction parallel to the longitudinal axis to a circular pad head surface;

wherein sliding the ground electrode pad into the receptacle includes arranging the pad flange and the pad base of the ground electrode pad beneath the base flange of the receptacle to restrict movement of the ground electrode pad along the spark plug longitudinal axis, and such that the linear portion of the ground electrode pad extends beyond the base flange;

wherein the base flange and a remainder of the ground electrode base defining the receptacle all have an identical coefficient of thermal expansion.

* * * * *